US006431204B1

(12) United States Patent
Ball

(10) Patent No.: US 6,431,204 B1
(45) Date of Patent: Aug. 13, 2002

(54) SOLENOID ACTUATED WALL HYDRANT

(75) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 0 days.

(21) Appl. No.: 09/954,250

(22) Filed: Sep. 17, 2001

(51) Int. Cl.[7] ..... F16K 3/06
(52) U.S. Cl. ..... 137/360; 251/129.04; 312/229
(58) Field of Search ..... 137/360; 251/129.04; 312/229

(56) References Cited

U.S. PATENT DOCUMENTS 3,638,680 A 2/1972 Kopp
3,818,874 A * 6/1974 Tria ..... 122/504
4,429,422 A 2/1984 Wareham
D284,302 S 6/1986 Hammarstedt
4,784,303 A 11/1988 Ahad et al.
4,884,725 A 12/1989 Ahad et al.
5,135,028 A 8/1992 Rickenbach et al.
5,226,629 A 7/1993 Millman et al.
5,555,907 A * 9/1996 Philipp ..... 137/312
5,911,240 A 6/1999 Kolar et al.
5,961,095 A 10/1999 Schroff

* cited by examiner

*Primary Examiner*—A. Michael Chambers

(57) ABSTRACT

A wall hydrant assembly with a faucet head mounted to an exterior wall of a building and connected to an outlet pipe that extends through the exterior wall to a solenoid valve located in an interior area. An inlet pipe is connected to a water supply at one end and the solenoid valve at the other. An actuating means is operatively connected to the solenoid valve for controlling the valve to allow and prevent water to flow from the water supply to the faucet head.

6 Claims, 2 Drawing Sheets

SOLENOID ACTUATED WALL HYDRANT

BACKGROUND OF THE INVENTION

Wall hydrants are well known in the art and include a variety of parts to control the flow of water from a water supply. Further, the delivery tube or outlet pipe of present wall hydrants must be of a rigid material and be of a predetermined length in order to contribute to the function of the faucet and ensure that the valve seat of the faucet is positioned in an area of the interior of the house where it is remote from outside freezing conditions. Because the control mechanisms are contained at each faucet head, multiple parts are required which can add to the installation expense. Further, the need for a rigid material of a predetermined length also adds to the expense and flexibility of installation. Because of these problems, a need exists for a simpler device to control the flow of water to a wall hydrant that is easy and economical to manufacture and install.

An objective of the present invention is to provide a wall hydrant that has a minimum number of parts.

A further objective of the present invention is to provide a wall hydrant that is economical to manufacture.

A still further objective of the present invention is to provide a wall hydrant that is easy to install and operate.

BRIEF SUMMARY OF THE INVENTION

The wall hydrant has a faucet head that is mounted to the exterior wall of a building. Connected to the faucet head, and extending through the exterior wall, is an outlet pipe. Connected to a water supply is an inlet pipe. Positioned inside the exterior wall and connected between the outlet and inlet pipes is a solenoid valve that controls the flow of water from the water supply to the faucet head. The solenoid valve is controlled by an actuating means.

DETAILED DESCRIPTION OF THE INVENTION

Figure 1:
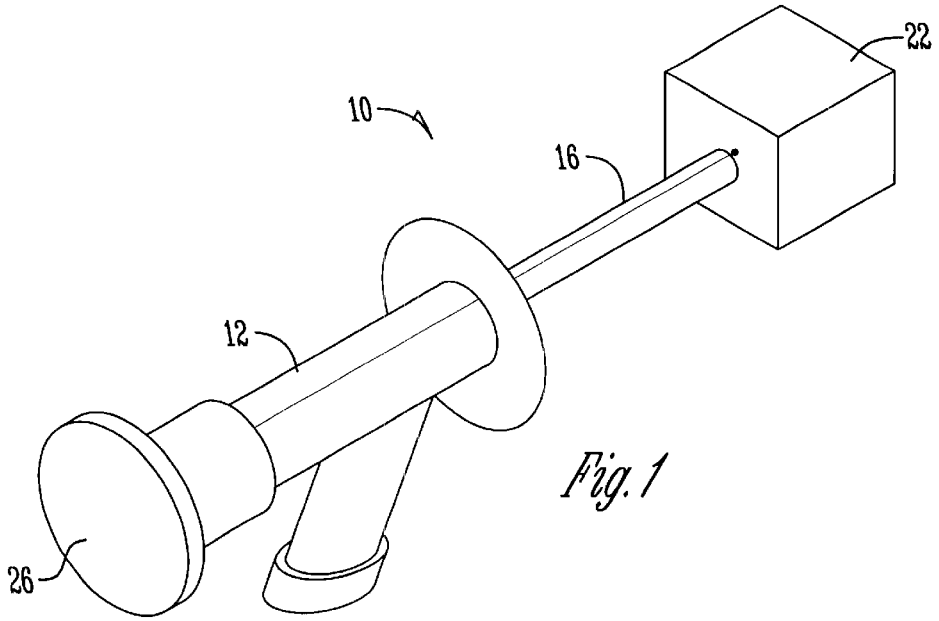
FIG. 1 is a perspective view of the invention.

Referring to the drawings, the wall hydrant assembly of the present invention is designated generally by the number 10. The assembly includes a faucet head 12 mounted to the exterior wall 14 of a building. Connected to the faucet head 14 is an outlet pipe 16 that extends through the exterior wall 14 of the building to an interior area 18 of the building.

Within the interior area 18 is an inlet pipe 20 that is connected to a water supply (not shown). Within the interior area is a solenoid valve 22 that connects the inlet pipe 20 to the outlet pipe 16. The solenoid valve 22 can be of any conventional type that prevents the flow of water when closed and allows water to flow when open. The solenoid is powered by a common household breaker 24.

The solenoid valve 22 is controlled by an actuating means that opens the solenoid valve to allow water to flow through the outlet pipe 16 to the faucet head 12 and closes the solenoid valve 22 to prevent water from flowing into the outlet pipe 16 to the faucet head 14. In one embodiment, the actuating means includes a switch 26 mounted on the faucet head 12 and electrically connected to the solenoid valve 22 as shown in FIG. 1. In another embodiment, the actuating means includes a switch mounted to the faucet head 12 that transmits an actuating signal to a receiver (not shown) within the solenoid valve 22. While these embodiments are shown as examples, other embodiments having a remote switch that transmits a signal via phone or computer are included. Also, a central box with electronic timers to actuate the solenoid valve 22 is included.

Figure 2:
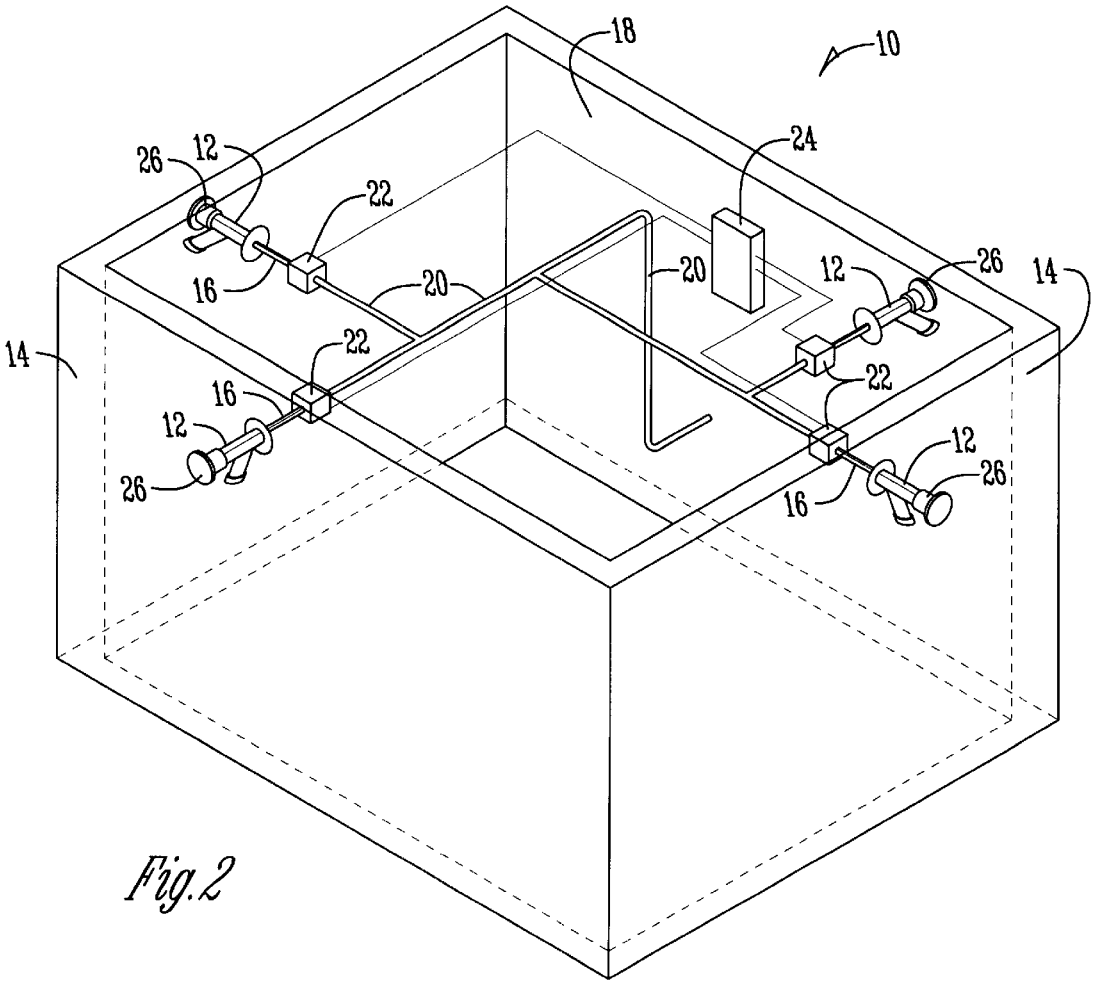
FIG. 2 is a perspective view of the invention assembled in a building.
Figure 3:
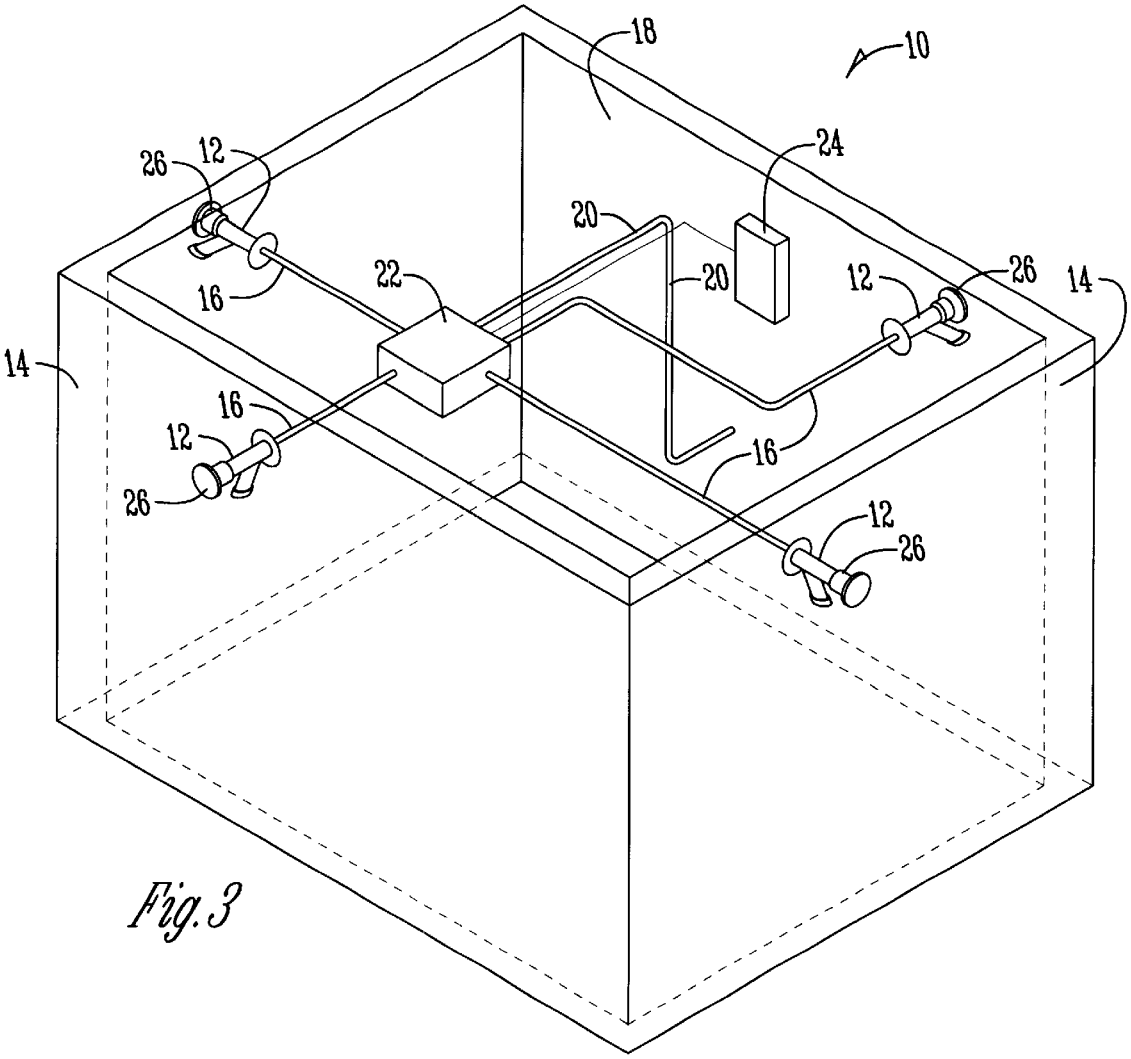
FIG. 3 is a perspective view of the invention assembled in a building with a centralized solenoid valve.

For ease in installation, a plumber can locate the solenoid valve 22 in a central location, as shown in FIG. 3, or at other locations within the interior area 18 of the building that are convenient for repair and maintenance (see FIG. 2).

When centrally located, the solenoid has several valves that operate independently of one another to allow water to flow through various outlet pipes to faucet heads.

The wall faucet assembly 10 can be adapted to a sprinkler system by attaching existing sprinkler heads (not shown) to the faucet heads 12. Such a system is easily winterized by unscrewing the sprinkler heads from the faucet heads 12.

As can be seen, the present assembly eliminates many of the parts used with a traditional wall hydrant. This invention eliminates the need for a handle screw, wheel handle, packing nut, packing, packing support washer, valve stem, check valve, valve seat, and retainer screw. Instead, water flow is controlled solely by the solenoid valve 22.

In addition, because the outlet pipe 16 is only used to deliver water, rather than contribute to the valve mechanisms function, the outlet pipe 16 can be made of less rigid and more economical materials. Further, the outlet pipe can be of different lengths. Presently, specified lengths are required to ensure that the valve seat rests in an area of the building that is remote from outside freezing conditions. Because weather conditions vary throughout the country, the valve stem assembly must be made in different lengths along with the corresponding outlet pipe. With the elimination of traditional wall hydrant parts and the ability to position the solenoid valve 22 anywhere in the interior area 18, no standardized length is required for the outlet pipe 16.

Having described the present invention, it can be seen that it achieves its stated objectives by eliminating parts, thus reducing costs, and providing a device that is easy to install and operate. Having described the preferred embodiment, it will become apparent that various modifications can be made without departing from the scope of the invention, as defined in the accompanying claims.

What is claimed is:

1. A wall hydrant assembly mounted to an exterior wall of a building with a closed interior, comprising:

a faucet head mounted on the exterior wall of the building;

an outlet pipe connected to the faucet head and extending through the exterior wall of the building to the closed interior;

an inlet pipe located in the interior of the building connected to a water supply;

a solenoid valve positioned inside the exterior wall and connected to both the outlet pipe and inlet pipe to open and close to allow and prevent respectively the flow of water from the water supply to the faucet head; and an actuating means operatively connected to the solenoid valve for controlling the same.

2. The assembly of claim 1 wherein the actuating means comprises a switch mounted on the faucet head and electrically connected to the solenoid valve.

3. The assembly of claim 1 wherein the actuating means comprises a switch mounted on the faucet head that transmits an actuating signal to a receiver within the solenoid valve.

4. A wall hydrant assembly mounted to an exterior wall of a building with a closed interior, comprising:

a plurality of faucet heads mounted on the exterior wall of the building;

a plurality of outlet pipes connected to the faucet heads and extending through the exterior wall of the building to the closed interior;

an inlet pipe located in the interior of the building connected to a water supply;

a solenoid valve positioned inside the exterior wall and connected to both the outlet pipes and inlet pipe to open and close to allow and prevent respectively the flow of water from the water supply to the faucet heads; and an actuating means operatively connected to the solenoid valve for controlling the same.

5. The assembly of claim 4 wherein the actuating means comprises a plurality of switches mounted on the faucet heads and electrically connected to the solenoid valve.

6. The assembly of claim 4 wherein the actuating means comprises a plurality of switches mounted on the faucet heads that transmit actuating signals to a receiver within the solenoid valve.

* * * * *